United States Patent [19]

Sarkis

[11] 4,320,593

[45] Mar. 23, 1982

[54] FLYING AMUSEMENT DEVICE

[76] Inventor: Joseph E. Sarkis, 437 79 St., Brooklyn, N.Y. 11209

[21] Appl. No.: 962,468

[22] Filed: Nov. 20, 1978

Related U.S. Application Data

[63] Continuation-in-part of Ser. No. 851,819, Nov. 16, 1977, Pat. No. 4,171,704.

[51] Int. Cl.[3] ..... A63H 27/00

[52] U.S. Cl. ..... 46/74 D; 273/424

[58] Field of Search ..... 131/178; 273/106 B; 46/74 D

[56] References Cited

U.S. PATENT DOCUMENTS

| | | | |
|---|---|---|---|
| 3,724,122 | 4/1973 | Gillespie | 273/424 X |
| 3,786,246 | 3/1972 | Johnson et al. | 46/74 D |
| 3,852,910 | 12/1974 | Everett | 273/424 X |
| 3,900,986 | 8/1975 | Torres | 46/74 D |
| 3,900,987 | 8/1975 | Holt | 46/74 D |
| 4,134,229 | 1/1979 | Lehman | 46/74 D |
| 4,143,483 | 3/1979 | Kifferstein et al. | 46/74 D |
| 4,153,252 | 5/1979 | Sullivan | 273/106 B |

FOREIGN PATENT DOCUMENTS

| | | | |
|---|---|---|---|
| 2246469 | 3/1973 | Fed. Rep. of Germany | 46/74 D |

*Primary Examiner*—Stephen C. Pellegrino

*Attorney, Agent, or Firm*—Hubbell, Cohen, Steifel & Gross

[57] ABSTRACT

A disc of the type adapted for manual toss and glide having weighted members added to enhance flight characteristics is also disclosed.

7 Claims, 9 Drawing Figures

FLYING AMUSEMENT DEVICE

CROSS-REFERENCE TO RELATED APPLICATION

This application is a continuation-in-part of my application Ser. No. 851,819 for Flying Pipe, filed Nov. 16, 1977 now U.S. Pat. No. 4,171,704.

BACKGROUND OF THE INVENTION

1. Field of the Invention

This invention pertains to a disc of the type adapted for manual toss and glide.

2. Prior Art

Manual toss and glide devices are well known. See, for example, U.S. Pat. No. 3,359,678 assigned to the Wham-O Manufacturing Company.

In one such manual toss and glide device of the type comprised of a central circular disc having a depending peripheral side wall, an elongate cone-shaped member extends downwardly from the disc well below the side wall. However, this member, which serves as a handle for catching the device, adversely affects its aerodynamics.

SUMMARY OF THE INVENTION

According to the present invention, I have developed a flying disc which serves both as a pipe and an amusement device.

In accordance with the preferred embodiment, the flying disc includes a disc of the type adapted for manual toss and glide and a housing defining a chamber for receiving a smokeable substance. The housing is desirably a hollow generally cylindrical member comprised of a central portion having a pair of end portions removably secured thereto. The disc may, for example, be a Frisbee ® brand flying saucer such as the type made by the Wham-O Manufacturing Company.

The housing may be secured to the disc in a number of ways. Preferably, the central portion of the housing includes a portion of reduced diamater adjacent one end thereof which extends through a hole provided in the middle of the disc. The portion extending through the hole then may be secured to one end portion thereby securing the pipe to the disc. This may be accomplished, for example, by threadably engaging an internally threaded wall of the end portion with an externally threaded wall of the portion extending through the hole.

The other end portion of the housing is also preferably removably secured to the central portion to provide easy access to the housing chamber for facilitating placement of a smokeable substance therein. Typically, the smokeable substance will be tobacco, although, one may wish to use other smokeable substances. A pair of apertures, preferably one in each end portion of the housing, are also provided as are means, such as screens, for blocking passage of the smokeable substance through the apertures.

To use the pipe, a flame is placed adjacent one of the apertures of igniting the smokeable substance in the chamber and the smoke is drawn through the aperture in the other end portion which serves as a mouthpiece. Preferably, the portion of the flying disc adjacent the housing is comprised of a transparent material, such as clear plastic, so the user can see the flame and properly position it for igniting the smokeable substance in the chamber. To prevent the mouthpiece from getting too hot, it should be comprised of a material which displays low thermal conductivity.

When the flying pipe is being smoked, the disc serves as a handle. Moreover, since the pipe apertures are disposed on opposite sides of the disc, the disc serves to shield the flame from the user's neck and face. After smoking the pipe, the first user may then toss the disc to a second user and so on. It is important to note that the tossing operation, in addition to being a form of amusement, also serves to cool the housing and hence the smoke.

When the smokeable substance has been used up, one of the end portions may be removed, the residue emptied and a fresh supply of the same or a different smokeable substance inserted in the chamber. The end portion may then be resecured whereupon the pipe is once again ready for use.

I have found that when the housing is disposed in the center of the flying disc and the lower portion thereof terminates no lower than substantially at the plane defined by the lower edge of the outer wall of the disc, the weight of the lower portion enhances the flight characteristics of the flying disc and in particular its flight distance and stability.

The flying pipe may be modified by adding one or more whistles which are rendered audible during flight. The whistles are preferably disposed in apertures in the disc provided for this purpose and air scoops are preferably provided above the whistles to channel air into the whistles during flight.

These and further features of the flying pipe of the present invention will become more fully apparent from the following detailed description of the preferred embodiment thereof.

DETAILED DESCRIPTION OF THE PREFERRED EMBODIMENTS

Figure 1:
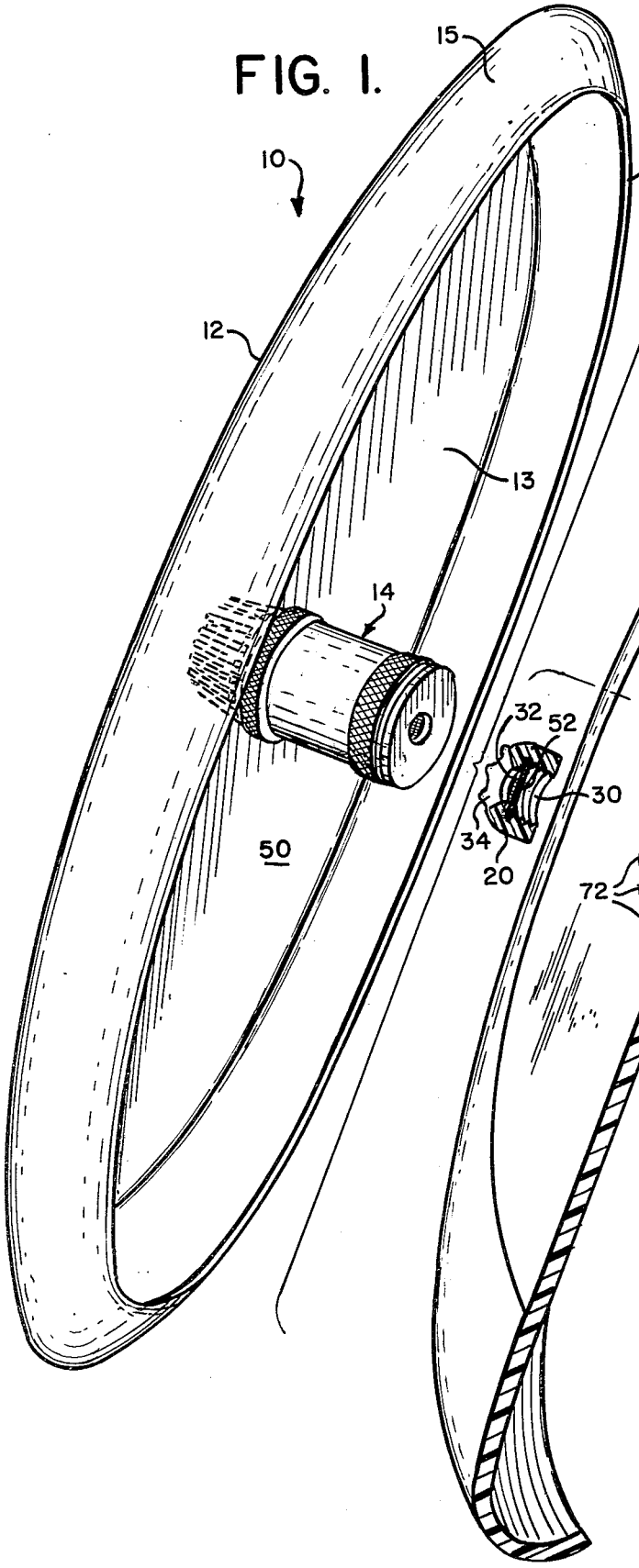
FIG. 1 is a perspective view, partly in phantom, of the flying pipe of the present invention.

Referring now to the drawings wherein like numbers indicate like parts, the flying pipe of the present invention is generally designated by the reference numeral 10 and includes a disc 12 of the type adapted for manual toss glide and a housing 14 defining a chamber 16 for receiving a smokeable substance (not shown).

The disc 12 may be any one of those generically referred to as "flying discs" or "flying saucers" such as, for example, the Super Pro Frisbee® manufactured by the Wham-O Manufacturing Company, San Gabriel, Calif. As shown with respect to the disc 12, such discs typically comprise a round substantially planar central section 13 having a depending peripheral sidewall 15. As presently preferred and shown, the housing 14 is comprised of a hollow generally cylindrical member having a central portion 18 and end portions 20 and 22.

As illustrated, central portion 18 includes a main portion 24 having an internally threaded wall 26 and a portion of reduced diameter 28 having an externally threaded wall 29. End portion 20 includes an internally threaded cylindrical wall 30 and has an aperture 32 in the transverse wall 34 thereof. The other end portion 22 of the cylindrical member 14 has an externally threaded cylindrical wall 36 and, like the end portion 20, has an aperture 38 in the transverse wall 40 thereof.

As presently preferred and shown, disc 12 has a hole 42 in the center thereof. The diameter of the hole 42 is greater than that of the portion 28 of central cylinder portion 18 but less than that of main portion 24 and end portion 20. Thus, and as shown, end portion 20 and central portion 18 of the cylindrical housing 14 may be secured to each other and to disc 12 by inserting portion 28 through hole 42 and threadably engaging internally threaded wall 30 with externally threaded wall 28. As best shown in FIG. 1, when this is done, transverse annular wall 44 of end portion 20 will be firmly seated adjacent planar surface 46 of the disc 12 and annular transverse wall 48 of the member 18 will be firmly seated adjacent planar surface 50 of the disc 12.

End portion 22 of cylindrical housing 14 is also preferably removably secured to central portion 18. As illustrated, this is accomplished by threadably engaging externally threaded wall 36 of end portion 22 with internally threaded wall 26 of central portion 18.

The pipe 10 also includes means for preventing passage of the smokeable substance through the apertures 32, 38. Desirably, the blocking means comprises screens 52 and 54 seated in the end portions 20 and 22, respectively, in overlying relation with the holes 32 and 38. As presently preferred and shown, an additional screen 56 is disposed in the central portion 18 of the housing 14 between chamber portions **16*a* and 16*b* whereby to prevent passage of the smokeable substance therebetween. While the screens 52, 54 and 56 are preferably fixedly secured to the housing 14**, this is not necessary and the screens could, alternatively, be press fitted in place.

In use, the smokeable substance is disposed in the chamber portion **16*a*. The end portion 22 of housing 14 is then secured to the central portion 18 in the manner more fully described above. The substance may then be smoked by placeing a match, lighter or other flame source adjacent aperture 38 for igniting the smokeable substance with the resulting smoke being drawn out of chamber 16 through aperture 32 in end portion 22 which, in the embodiment shown, serves as the mouthpiece of the flying pipe 10. Thus, unlike portions 18 and 22 of cylindrical housing 14 which are preferably comprised of any one of a number of suitable metals or their alloys well known to persons skilled in the art, end portion 20** is preferably comprised of plastic such as, for example, polypropelyne or polyethelyne. As is well known, plastic is a relatively poor conductor of heat and thus will prevent the mouthpiece from becoming too hot. Of course, other materials which display poor thermal conductivity may also be used.

As presently preferred and shown, the portion 60 of the disc 12 adjacent the housing 14 is comprised of a transparent material, such as a clear plastic, which permits the user to see the flame and properly position it adjacent the aperture 38 for igniting the smokeable substance in the chamber 16. While the portion 60 may be affixed to the outer portion 62 of the flying disc 12 in a variety of ways, the portion 60 preferably includes a plurality of depending legs (not shown) which may be snap fitted in holes (not shown) in the outer portion 62.

While the pipe 10 is being smoked, the body of the disc 12 provides a convenient handle, and since it too is preferably comprised of plastic or some other non-metallic substance, the disc 12 will also remain cool.

When the first user of the pipe 10 is done smoking, he can then pass the pipe to a second user by simply tossing the disc 12 to him in the conventional manner. The second user can then repeat the smoking operation described above and then pass the pipe 10 back to the first user or to a third person. Moreover, the passing of the pipe 10 between the users by manual toss and glide not only provides amusement, but also serves the important function of cooling the cylindrical housing 14 of the pipe 10 and hence the smoke. Also, on windy days, disc 12 may be positioned to block the wind to facilitate lighting of the pipe. Furthermore, by selecting a cylindrical housing and disposing it at the center of the disc 12 as illustrated in the preferred embodiment, the adverse effect, if any, to the aerodynamics of the disc 12 may be minimized.

Figure 3:
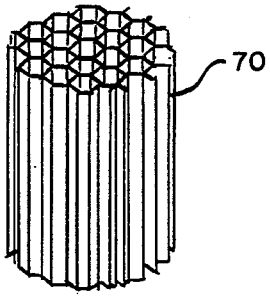
FIG. 3 is a perspective view of a honeycomb screen which may be incorporated in the flying pipe of the present invention.

When the smokeable substance is used up, end portion 22 is removed from central portion 18 and the chamber **16*a* emptied. A fresh supply of the same or a different smokeable substance may then be disposed in the chamber 16*a* and end portion 22 resecured to central portion 18 whereupon the pipe 10 is again ready for use. Clearly, the screens 52 and 54 are necessary to prevent the smokeable substance from falling out of the chamber 16*a* while still allowing the flame to penetrate into the chamber 16*a* through aperture 38 and the smoke to be drawn out through aperture 32. The screen 56 is included to further reduce the possibility that any of the smokeable substance or residue will be drawn into the user's mouth along with the smoke. The screens 52 and 56 may be replaced with a honeycomb screen, such as the honeycomb screen 70 illustrated in FIG. 3 which is dimensioned to extend throughout chamber 16*b*. By increasing the surface area contacted by the smoke and reducing its turbulence, the honeycomb screen 70 serves to reduce the harshness of the smoke drawn into the user's mouth. Of course, the screen 70 may be used in addition to the screens 52 and 56 if the openings in the screen 70** are too large to block passage of the smokeable substance therethrough.

While the preferred flying pipe 10 of the present invention has been shown and described, it will be apparent to those skilled in the art that numerous modifications and changes may be made without departing from the spirit and scope of this invention. Thus, housing 14 need not by cylindrical and may be secured to the disc 12 in a variety of ways well known to persons skilled in the art other than that described above. Similarly, means other than a removable end portion 22 may be provided for gaining access to the chamber **16*a*. For example, a small latch door may be provided in the wall defining the chamber 16*a*. Also, means other than screens may be used for preventing the smokeable substance from passing out of the chamber 16a through the apertures 32 and 38. Thus, for example, apertures 32 and 38 may be replaced by a plurality of much smaller apertures which could then serve the dual function now served by the combination of apertures 32, 38 and screens 52, 54. Also, while the pipe apertures 32, 38 are preferably disposed on opposite sides of disc 12**, this too is not necessary and other pipe aperture locations will also serve.

Figure 2:
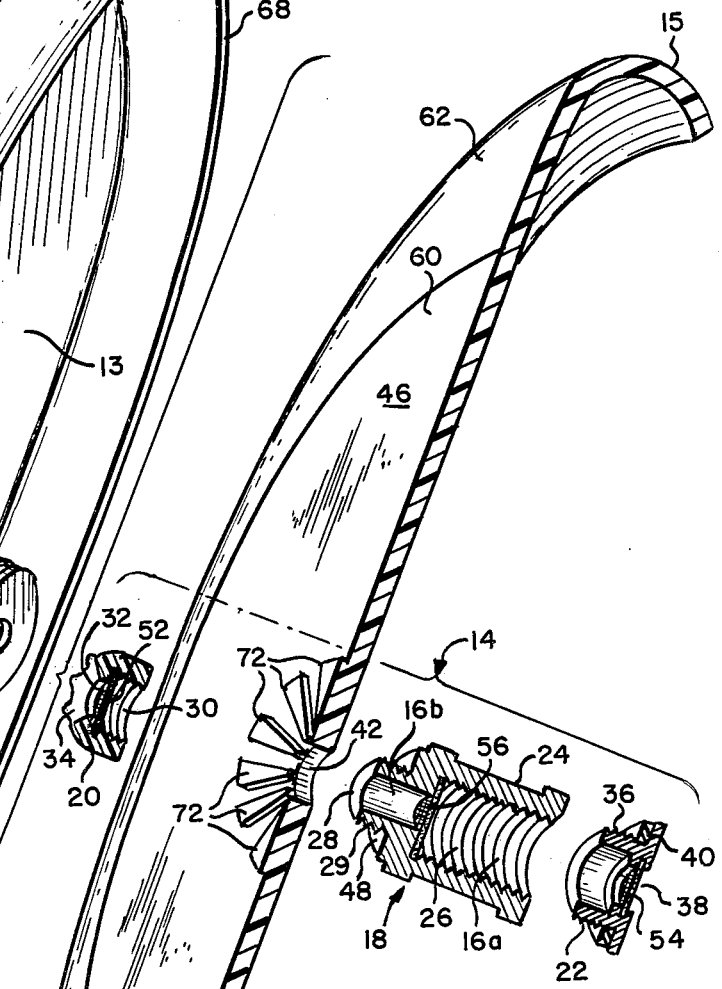
FIG. 2 is an exploded perspective sectional view of the flying pipe illustrated in FIG. 1.

In addition, to provide added strength and durability to the flying pipe 10 of the present invention, it may be desirable to incorporate ribbing in the flying disc 12 adjacent the aperture 42. Such ribbing may comprise, for example, the ribs 72 illustrated in FIG. 2. If desired, an L-shaped clip, having one leg pivoted to the central portion 18 of the housing 14 and movable to a position in which the other leg overlies end portion 22, may be added to prevent accidental disattachment of end portion 22 from central portion 18 during flight. Means other than clips as well as other types of clips may also be used for this purpose.

Figure 4:
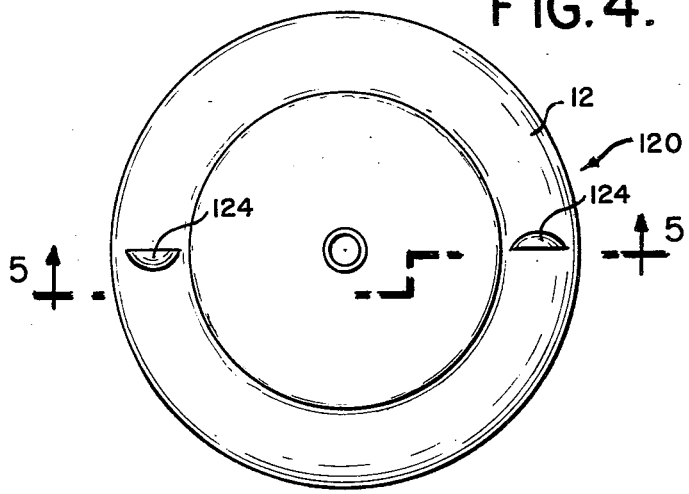
FIG. 4 is a top plan view of the flying pipe of FIGS. 1 and 2 modified by the addition of whistles.
Figure 5:
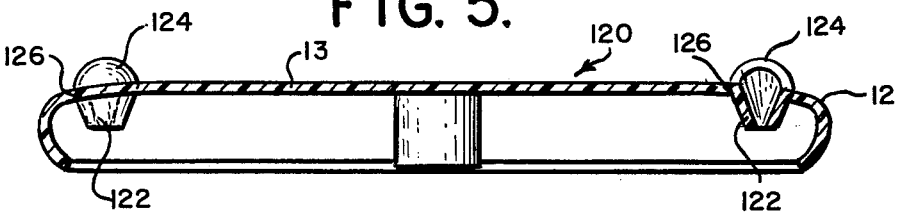
FIG. 5 is a sectional view taken substantially along the line 5—5 in FIG. 4.

It is also possible to incorporate one or more whistles in the flying pipe 10. The whistle will sound during flight thus aiding the recipient or a toss to locate the Frizbee when ambient lighting is poor. For example, referring to FIGS. 4 and 5, the flying pipe 120 is in all respects identical to the flying pipe 10 of FIGS. 1 and 2 except for the addition of whistles 122 and air scoops 124. As shown, the whistles 122 are secured, as by a suitable adhesive or a force-fit, in apertures 126 in the central portion 13 of the disc 12. As preferred and shown, the air scoops 124 are secured to the central portion 13 above the whistles to channel air through the whistles during flight. While the air scoops 124 shown in FIGS. 4 and 5 are oriented to channel air through the whistle during clockwise rotation of the device 120, scoops oriented to channel air into the whistles during counterclockwise rotation may be substituted. Also, while two whistles and air scoops are shown in FIGS. 4 and 5, one or more than two whistles and scoops may be used, and where two or more are used, the scoops may be oriented to channel air through the whistles during both clockwise and counterclockwise rotation of the disc.

I have also found that the weight of the lower portion of the housing 14 comprised of the members 18 and 22 lowers the center of gravity of the device 10 and imparts a "gyroscopic" effect to the disc 12 which enhances its flight characteristics and in particular its flight distance and stability. Of course, this enhancement can be achieved by employing a weighted member configured other than as a pipe. However, to be effective, the weight of the weighted member disposed beneath the central portion 13 of the disc 12 must be distributed evenly about the center of the disc and the weighted member must terminate no lower than substantially at the plane defined by the lower edge 68 of the depending sidewall 15. To reduce the likelihood of injury, the weighted member will most preferably terminate above the plane defined by the edge 68.

Figure 6:
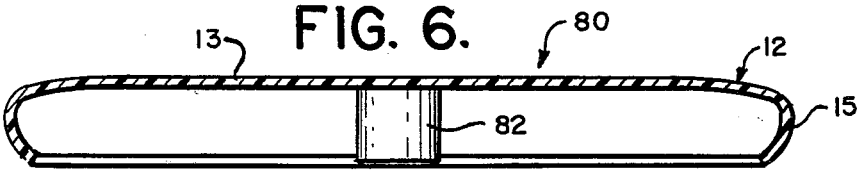
FIG. 6 is a sectional view of a flying disc modified in accordance with the present invention by the addition of a weighted member.

For example, referring to FIG. 6, the flight characteristics of the flying disc 12 of the device 80 are enhanced by a solid cylindrical weighted member 82. As shown, the weighted member 82 depends from the section 13 at the center thereof and terminates above the plane defined by the lower edge 68 of the sidewall 15.

The weighted member may assume still other shapes. For example, referring to FIG. 7, the device 90 illustrated therein is in all respects identical to the device 80 of FIG. 6 save for the fact that the weighted member 82 is replaced by a weighted member 92 comprising a rod 94 having a disc 96 secured to the free end thereof. Similarly, the device 100 illustrated in FIG. 8 is in all respects identical to the device 80 of FIG. 6 save for the fact that the weighted member 102 is disc-shaped.

Figure 7:
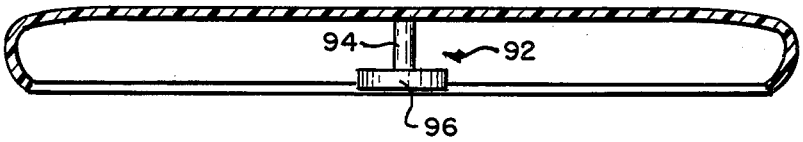
FIG. 7 is a view similar to FIG. 6 showing an alternative weighted member.
Figure 8:
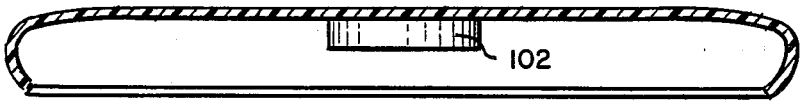
FIG. 8 is a view similar to FIG. 6 showing a still different weighted member.
Figure 9:
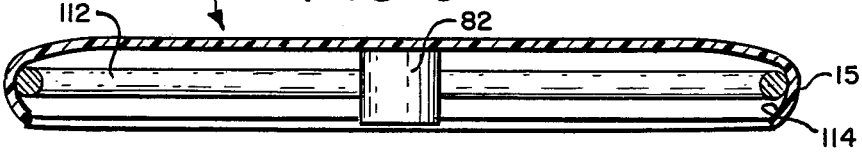
FIG. 9 is another view similar to FIG. 6 showing a disc modified by the addition of two weighted members.

Moreover, additional weighted members whose weight is distributed evenly about the center of the disc 12 may be added to the embodiments of FIGS. 6–8. For example, referring to FIG. 9, the device 110 is identical to the device 80 of FIG. 4 except for the addition of an annular weighted member 112 secured to the internal surface 114 of the sidewall 15. Of course, the annular weighted member 112 could be added to the embodiments of FIGS. 7 and 8 as well.

The weight of the weighted member may vary, although if it is too light it effect will be limited while if it is too heavy, the range of flight of the disc 12 will be reduced rather than enhanced. Accordingly, the ratio of the weight of the flying disc to the weight of the weighted member should be no greater than 8 to 1 and no less than 2 to 1 with about 4 to 1 being optimum. In particular, I have found that when a flying disc weighing about 130 grams is employed, the weighted member should weigh about 28 grams and that when a flying disc weighing about 150 grams is employed, the weighted member should weight about 40 grams. When a weighted member is disposed in the center of the disc as in the embodiments of FIGS. 6–9, the gyroscope effect may be proven by providing a small hole in the middle of the bottom of the weighted member and disposing the hole on the pointed end of a rod. If the disc is then spun, it will not fall off the pointed end of the rod even if the device is tilted at an angle with respect to the horizontal.

The weighted member may be secured to the disc 12 in a number of ways. For example, an arrangement similar to the arrangement shown in FIGS. 1 and 2 for securing the end portion 20 to the central portion 18 of the housing 14 may be used. Alternatively, the upper end of the weighted member may be provided with upstanding legs which may be snap-fitted in holes in the center of the disc provided for that purpose. Moreover, this arrangement permits substitution of one weighted member for another. Alternatively, a suitable adhesive may be used. Suffice to say that the means for securing the weighted member to the disc 12 should be sufficient to prevent the weighted member from becoming detached from the disc upon impact with a wall, tree, etc. which may be expected during normal use.

Since these and other modifications are within the scope of the present invention, the above description should be construed as illustrative and not in the limiting sense.

What is claimed is:

1. In a flying disc of the type comprising a circular central portion having substantially planar top and bottom surfaces and a sidewall integral with and depending from said central portion around the entire periphery thereof, the improvement which comprises:

an annular weighted member concentric with said disc and secured to the internal surface of said sidewall, the weight of said annular weighted member being substantially eveny distributed about the center of said disc; and an additional weighted member disposed at the center of said disc with its weight substantially evenly distributed thereabout, said additional weighted member depending from said bottom surface and extending no lower than the plane defined by the free edge of said sidewall, the width of said additional weighted member being substantially less than the diameter of said disc.

2. The device of claim 1, wherein said additional weighted member terminates above said plane.

3. The device of claim 1, wherein said additional weighted member is disc-shaped.

4. The device of claim 1, wherein said additional weighted member is cylindrically shaped.

5. The device of claim 1, wherein said additional weighted member is annular.

6. The device of claim 1, wherein the ratio of the weight of the flying disc to the weight of the weighted members is greater than or equal to 2 to 1 but less than or equal to 8 to 1.

7. The device of claim 6, wherein said ratio is about 4 to 1.

* * * * *